US009902919B2

(12) United States Patent
Kieser et al.

(10) Patent No.: US 9,902,919 B2
(45) Date of Patent: Feb. 27, 2018

(54) ELECTRORHEOLOGICAL COMPOSITIONS

(71) Applicant: Hitachi Automotive Systems Europe GmbH, Schwaig/Oberding (DE)

(72) Inventors: Daniel Kieser, Eisingen (DE); Dorothea Adams, Buettelborn (DE); Heinz Ulrich Hensgen, Frankfurt (DE)

(73) Assignee: Hitachi Automotive Systems Europe GmbH, Schwaig/Oberding (DE)

( * ) Notice: Subject to any disclaimer, the term of this patent is extended or adjusted under 35 U.S.C. 154(b) by 12 days.

(21) Appl. No.: 14/384,023

(22) PCT Filed: Mar. 11, 2013

(86) PCT No.: PCT/EP2013/000707
§ 371 (c)(1),
(2) Date: Sep. 9, 2014

(87) PCT Pub. No.: WO2013/131659
PCT Pub. Date: Sep. 12, 2013

(65) Prior Publication Data

US 2015/0080279 A1 Mar. 19, 2015

(30) Foreign Application Priority Data

Mar. 9, 2012 (DE) ..... 10 2012 004 586

(51) Int. Cl.

| | |
|---|---|
| ***C07F 5/04*** | (2006.01) |
| ***C10L 1/22*** | (2006.01) |
| ***C09K 5/00*** | (2006.01) |
| ***C10M 171/00*** | (2006.01) |

(52) U.S. Cl.
CPC .. *C10M 171/001* (2013.01); *C10M 2207/122* (2013.01); *C10M 2207/123* (2013.01); *C10M 2207/124* (2013.01); *C10M 2207/126* (2013.01); *C10M 2207/141* (2013.01); *C10M 2209/1033* (2013.01); *C10M 2209/1045* (2013.01); *C10M 2215/14* (2013.01); *C10M 2219/042* (2013.01); *C10M 2229/02* (2013.01); *C10M 2229/0405* (2013.01); *C10M 2229/0465* (2013.01); *C10M 2229/051* (2013.01); *C10N 2210/01* (2013.01); *C10N 2230/12* (2013.01); *C10N 2230/60* (2013.01); *C10N 2250/02* (2013.01)

(58) Field of Classification Search
CPC ..... C10M 105/18; C10M 2229/04; C10M 2229/02
USPC ..... 252/73; 508/243
See application file for complete search history.

(56) References Cited

U.S. PATENT DOCUMENTS

| | | | | |
|---|---|---|---|---|
| 3,047,507 | A | 7/1962 | Winslow | |
| 4,668,417 | A | 5/1987 | Goossens et al. | |
| 4,744,914 | A | 5/1988 | Filisko et al. | |
| 5,164,105 | A | 11/1992 | Ishino et al. | |
| 5,268,118 | A * | 12/1993 | Bloodworth | C10M 171/001 252/572 |
| 5,462,687 | A * | 10/1995 | Podszun | C08J 3/09 252/572 |
| 5,891,356 | A | 4/1999 | Inoue et al. | |
| 5,948,852 | A | 9/1999 | Wendt et al. | |
| 8,318,041 | B2 | 11/2012 | Uebe et al. | |

FOREIGN PATENT DOCUMENTS

| | | |
|---|---|---|
| DE | 40 26 881 | 2/1992 |
| DE | 102009048825 | 4/2011 |
| EP | 0 472 991 | 3/1992 |
| EP | 0 567 649 | 11/1993 |
| EP | 0 824 128 | 2/1998 |
| EP | 2 016 117 | 1/2009 |
| WO | WO 97/005076 | 2/1997 |
| WO | WO 07/121942 | 11/2007 |

OTHER PUBLICATIONS

International Search Report of the International Searching Authority for International Application PCT/EP2013/000707, dated Jul. 5, 2013, 3 pages, European Patent Office, HV Rijswijk, Netherlands.
PCT International Preliminary Report on Patentability including English Translation of PCT Written Opinion of the International Searching Authority for International Application PCT/EP2013/000707, dated Sep. 9, 2014, 6 pages, International Bureau of WIPO, Geneva, Switzerland.
Office Action in German Patent Application No. 10 2012 004 586.7, dated Sep. 19, 2013, 4 pages, with partial English translation, 2 pages.
Anna Krzton-Maziopa et al., "Electrorheological Fluids Based on Polymer Electrolytes", Electrochimica Acta, Elsevier Science Publishers, Jun. 30, 2005, Barking, GB, XP004933856, vol. 50, No. 19, pp. 3838 to 3842.
W. M. Winslow, "Induced Fibration of Suspensions", AIP Journal of Applied Physics 20, 1949, pp. 1137 to 1140.

* cited by examiner

*Primary Examiner* — Prem C Singh
*Assistant Examiner* — Frank C Campanell
(74) *Attorney, Agent, or Firm* — W. F. Fasse

(57) ABSTRACT

An electrorheological composition has corrosion-inhibiting properties and contains at least one organic ionic compound as an electrolyte. Also disclosed are methods for the production thereof and the use thereof.

19 Claims, No Drawings

ELECTRORHEOLOGICAL COMPOSITIONS

FIELD OF THE INVENTION

The present invention relates to an electrorheological composition with corrosion-inhibiting properties, methods for the production thereof as well as the use thereof.

BACKGROUND INFORMATION

Non-aqueous dispersions and emulsions are increasingly gaining importance. Especially they are used as electrorheological fluids or compositions that are present as liquid, gels or paste. Under the term electrorheological fluids, one understands dispersions of small-sized particles in hydrophobic and electrically non-conducting oils. The apparent viscosity of these dispersions changes under the influence of an electric constant or alternating field, very quickly and reversibly from the liquid to the plastic or solid state, whereby the current consumption of the ERF shall be as small as possible.

The viscosity increase in an ERF upon application of an electric field is qualitatively to be explained as follows: The colloid-chemically stable dispersed particles polarize in the electric field and agglomerate due to the dipole interaction in the direction of the field lines. This leads to the increase of the apparent viscosity. The agglomeration is reversible: if the electric field is switched off, then the particles re-disperse and the viscosity is reduced to the original value. The electrical polarizability of the disperse phase is thus an important pre-condition or requirement for the establishment of the electrorheological effect. Therefore, ionic or electronically conductive materials are often used as the disperse phase or as an additive thereto.

In a portion of the ERF, which correspond to the state of the art, the disperse phase consists of organic solid substances, such as for example, ion exchange resins (U.S. Pat. No. 3,047,507) or silicone resins (U.S. Pat. No. 5,164,105). However, partially coated inorganic materials, such as e.g. zeolites (U.S. Pat. No. 4,744,914) or silica gel (U.S. Pat. No. 4,668,417) are also used. In the abovementioned substances, the electrorheological effect is to be attributed to the charging or loading of the solid substances with water. Small water contents or proportions increase the ionic conductivity and are thus advantageous for the establishment of the effect. Water-containing systems, however, have a low stability and go along with increased current densities. Solid materials such as partially coated metal powders or zeolites have the disadvantage that they have an abrasive effect. The abrasive wear can be strongly influenced by the selection of the disperse phase. Therefore, polymeric substances, especially elastomers, are preferable to the inorganic powders as the disperse phase e.g. in hydraulic applications. Moreover, homogeneous ERF are known, e.g. from U.S. Pat. No. 5,891,356.

ERF may be utilized everywhere where it is necessary to achieve the transmission of large forces with the aid of small electrical powers, such as e.g. in clutches, hydraulic valves, shock and vibration dampers, brake systems, vibrators, devices for positioning and fixing workpieces, exercise and sport devices or also for medical applications.

Besides the general requirements for an ERF, such as a good electrorheological effect, high temperature stability and chemical resistance, further factors play an important roll in the practical utilization. These include, e.g. the abrasivity, the base viscosity as well as the precipitation stability of the disperse phase. To the extent possible, the disperse phase should not precipitate out as sediment, but should however in each case be well re-dispersable, and even under high mechanical loading should not cause abrasion and should not underlie wear.

An effective electrorheological fluid shall thus have a lowest possible base viscosity, a highest possible shear stress, a lowest possible current uptake, and a high viscosity after application of the electric field, that is to say a large viscosity change or large hydraulic switching index. Moreover an effective ERF shall be utilizable over a wide temperature range (approximately −30° C. to approximately +150° C.) and comprise an excellent material tolerability.

As is known, the ER effect increases with the volume proportion of the disperse phase. Achieving a low base viscosity with a high solid material content or proportion is dependent on first the form or shape as well as the particle size distribution of the disperse phase and secondly the dispersion effect of possibly utilized dispersing auxiliary agents (see e.g. EP 2016117). Additionally, the conductivity of the disperse phase is also dependent on the particle size. The optimization of all properties of the ERF is only possible in connection with the exact adjustment or setting of the particle size or the particle size distribution of the disperse phase.

The abovementioned ERF corresponding to the state of the art are generally produced by dispersing a solid material into a dispersion medium such as e.g. halogen-free or halogenated hydrocarbons, aromatics or silicone oils. In that regard, the viscosity of the resulting suspension depends on the form or shape and the size or the size distribution of the dispersed particles, as well as the solid material concentration and the dispersion effect of possibly utilized dispersing auxiliary agents such as dispersion stabilizers. High volume-referenced solid material contents with low viscosity are only achievable with difficulty when using non-spherical particles.

However, in practice it has been found to be disadvantageous that the use of salts as an additive in the use of such ERF can lead to an undesired corrosion of the electrodes, which has a disadvantageous effect on the electrorheological effect and on the durability of the components.

Thus it is suggested in the patent application DE 10 2009 048 825 A1, basically to avoid the use of salt doping in ERF to achieve a corrosion-inhibiting effect in the use of ERFs. There it is suggested to use organic non-ionic doping agents.

The patent EP 0 567 649 B1 is also concerned with the problem of corrosion avoidance in the use of ERFs. There it is suggested to solve the problem through the use of corrosion inhibitors.

SUMMARY OF THE INVENTION

In view of the above, it is an object of at least one embodiment of the invention to provide an ERF with excellent electrorheological properties, which is characterized by a low corrosive effect on the electrodes under high electrical and mechanical loading, and which is utilizable in a wide temperature range.

It has now been surprisingly found that it is not necessary to avoid the use of ionic compounds for the production of corrosion-inhibiting ERF, if ERF on the basis of water-free polymers are produced, which contain certain organic ionic compounds such as e.g. metal salts. The electrorheological properties of such ERF can be adjusted or set in a targeted manner over wide ranges through the selection of the type and concentration of the electrolyte. Surprisingly, the ERF according to the invention comprise a high electrical dielectric breakdown strength, are utilizable in an extraordinarily wide temperature range from approximately −40° C. to a peak temperature of approximately +160° C., and can even be operated with lower-powered high-voltage electronics due to their excellent properties with respect to base viscosity and current uptake.

Therefore, the subject of at least one embodiment of the invention is an electrorheological composition containing essentially (I) a polymer or polymer mixture, (II) one or more electrolytes dissolved or dispersed in (I), (III) if applicable one or more additives miscible with the solution of (I) and (II), (IV) if applicable one or more viscosity-increasing additives that are reactive with (I); (V) one or more dispersing agents or deflocculating agents, as well as (VI) one or more non-aqueous dispersion media, whereby said electrolytes (II) are one or more organic ionic compounds, preferably organic salts, especially selected from the group consisting of alkali salts, alkaline earth salts and metal salts especially preferably zinc salts and lithium salts, and said composition is essentially free of interfering ions, that is to say inorganic anions, preferably free of chloride ions and sulfate ions and nitrate ions. In a further preferred embodiment, the content of inorganic ions in the electrorheological composition according to the invention amounts to not more than $1\times10^{-6}$ to $5\times10^{-3}$%, especially preferably not more than $1\times10^{-6}$ to $1\times10^{-3}$% (w/w).

In a further embodiment, the subject of the invention is an electrorheological composition containing essentially (I) a polymer or polymer mixture, (II) one or more electrolytes dissolved or dispersed in (I), (III) if applicable one or more additives miscible with the solution of (I) and (II), (IV) if applicable one or more viscosity-increasing additives that are reactive with (I); (V) one or more dispersing agents, as well as (VI) one or more non-aqueous dispersion media, whereby said electrolytes (II) are one or more organic ionic compounds, preferably organic salts, especially selected from the group consisting of alkali salts, alkaline earth salts, and metal salts, especially preferably zinc salts and lithium salts, and said composition is essentially free of interfering ions, that is to say inorganic ions, preferably free of chloride ions and sulfate ions and nitrate ions, except excluding a said electrorheological composition containing:

a) I) as the dispersion medium, polydimethylsiloxane (silicone oil) with a viscosity of 5 $mm^2/s$ at 25° C. and a density of 0.9 $g/cm^3$ at 25° C. and a dielectric constant $\in_r$ of 2.8 according to DIN 53 483 at 0° C. and 50 Hz;

ii) as the dispersed phase, trifunctional polyethylene glycol with a molecular weight of 675 Da, produced by ethoxylation of trimethylolpropane;

iii) as the dispersing agent, the reaction product of 100 parts by weight of an OH terminated polydimethylsiloxane with a molecular weight of 18200 and one part aminopropyltriethoxysilane;

iv) as a crosslinking agent, toluoylene-diisocyanate (TDI), and v) as an electrolyte, nonanoic acid in a ratio of 1:500 (Mol/Mol) to ethylene oxide, or b) as the electrolyte, sodium acetate.

In a further preferred embodiment, the polymer portion or component (I) of the electrorheological composition according to the invention consists of linear or branched, if applicable functionalized, polyethers or their oligomonomers, or the reaction or conversion product of such polyethers or their oligomonomers with mono- or oligofunctional compounds, preferably of polyurethanes, polyureas, poly(urethane ureas), poly(urethane amides), poly(urea amides), poly(acrylic acid esters), poly(urea amides), poly (urea siloxanes), poly(methacrylic acid esters), their copolymers, polyallophanates, polybiurets and/or copolymers of polyurethane blocks and polyvinyl blocks.

In still a further preferred embodiment, the monomeric and/or oligomeric initial substances or raw materials of the polymer component (I) of the electrorheological composition according to the invention are present in liquid form during the dispersing process, and if applicable can be converted into a higher viscosity or solid form by the addition of reactive additives (IV) before, during or after the dispersing.

In still a further preferred embodiment of the electrorheological composition according to the invention, said component (VI) contains one or more compounds selected from the group consisting of silicone oils, fluorine-containing siloxanes and hydrocarbons.

Instill a further preferred embodiment of the electrorheological composition according to the invention, said component (V) contains one or more compounds selected from the group consisting of polysiloxane-polyether-copolymerisates, amino-group-containing alkoxypolysiloxanes and amino-group-containing acetoxypolysiloxanes.

A second subject of at least one embodiment of the invention is a method for producing an electrorheological composition according to the invention with corrosion-inhibiting properties, wherein the initial substances or raw materials thereof, preferably (a) polymer or polymer mixture, (b) electrolyte or electrolyte mixture, (c) if applicable additives that are miscible and/or reactive with a) and b), (d) one or more dispersing agents, and/or (e) one or more non-aqueous dispersion media, are, before, during and/or after their processing, in a generally known manner, dispersed and essentially freed of inorganic anions, preferably of chloride ions, sulfate ions and/or nitrate ions. Especially preferably, the inorganic anions are removed from one or more of the educts, the intermediate products and/or the end product by means of suitable anion exchange media such as e.g. DOWEX™ G-26 (H) or DOWEX™ MAC-3.

A third subject of at least one embodiment of the invention is the use of one or more organic ionic compounds for producing an electrorheological composition with corrosion-inhibiting properties.

A fourth subject of at least one embodiment of the invention is the use of an electrorheological composition according to the invention in adaptive shock dampers, vibration dampers and/or impact dampers, electrically controllable clutches and/or brakes, in sport and/or medical exercise devices, in haptic and/or tactile systems, in operating elements, in mechanical fixing devices, in hydraulic valves, for the simulation of viscous, elastic and/or visco-elastic properties, for the simulation of the consistency distribution of an object, for exercise and/or development purposes, in protective clothing and/or in medical devices.

The dispersion polymerization of electrolyte-containing monomers, which is familiar to the skilled worker, as described e.g. in to EP 0 472 991 B1, EP 0 824 128 B1 or EP 2 016 117 B1 is especially suitable as a method for the production of the ERF according to the invention. The polymerization should preferably be carried out in the dispersion medium, which also represents the continuous phase of the ERF.

The substance mixture or its initial starting products are referred to as the basic substance in the following. The basic substance, which is dispersed into the non-conducting liquid during the production process of the ERF, shall preferably be present in a liquid form. If applicable, the basic substance can be chemically modified by the addition of suitable reagents (IV) before, during or after the dispersing step. Through the partial or complete transformation of the functional groups in the basic substance, this modification influences the consistency of the disperse phase in the finished ERF.

In order to avoid coalescence in the use of liquid phases, a suitable dispersing agent (V) is used during the dispersing.

In a further embodiment of the present invention, the average size of the dispersed particles ($d_{50}$) in the ERF according to the invention amounts to between 0.01 and 1000 μm, preferably between 0.02 and 300 μm, and especially preferably between 0.04 and 100 μm.

In this regard, $d_{50}$ means that 50% of all particles have a particle size that is smaller than or equal to the given value.

In still a further embodiment of the present invention, the electrolyte is dissolved in the particles, bound physically or chemically in or on the particles.

In still a further embodiment of the present invention, the electrolyte is contained, with respect to the total weight of the contained particles, in an amount of 0.01 to 40% (w/w) preferably 0.02 to 20% (w/w), especially preferably 0.05 to 10% (w/w).

In still a further embodiment of the present invention, the particle contents, with respect to the total electrorheological fluid, amount to between 1 and 70% (w/v), preferably between 2 and 65% (w/v), especially preferably between 5 and 60% (w/v).

In a further preferred embodiment of the present invention, the dynamic base viscosity of the ERF at 25° C. (room temperature) amounts to between 0.3 and 500 Pa*s (3 and 5000 cP) as measured according to DIN 51480-1.

In the disperse phase, the ERF according to the invention contains essentially the following components: a polymer (I) or polymer mixture; one or more dissolved or dispersed electrolytes (II), and if applicable one or more additives that are miscible with the solution of (I) and/or (II).

According to at least one embodiment of the invention, in principle all substances that comprise an electrolyte solubility or dispersability can be used as prepolymers or polymers. These include compounds selected from the group consisting of polyurethanes, polyureas, poly(urethane ureas), poly(urethane amides), poly(urea amides), poly (acrylic acid esters), poly(methacrylic acid esters), poly(urea siloxanes), their copolymers, polybiurets, polyallophanates, copolymers of polyurethane blocks and polyvinyl blocks and their derivatives. Furthermore, linear, branched or crosslinked polyethers or their copolymerisates, polyethylene adipate, polyethylene succinate and polyphosphazene are also preferably suitable. Especially preferred are also polyethers or polymers that can be produced by crosslinking of di- or tri-functional polyether oligomers. Examples of this are linear polyether oligomers such as polyethylene glycols, polypropylene glycols, polytetrahydrofurans, statistical ethylene glycol propylene glycol copolymerisates or ethylene glycol propylene glycol block copolymerisates (e.g. Pluronic™ (BASF SE, Ludwigshafen, Germany) or Igepal™ (GAF Chemicals Corp., Wayne, N.J., USA)), or branched polyether oligomers such as Tris(polypropylene oxide) ω-ol)glycidylether or such that are obtained by carboxylation, for example ethoxylation or propoxylation of higher functional hydroxy compounds, such as e.g. pentaerythrite or 1,1,1-trimethylolpropane. The molecular weight of suitable glycols lies between 62 and 1,000,000 Da, preferably between 100 and 10,000 Da. If applicable, the oligomers can contain one or more of the same or different functional groups. Preferably the polyether oligomers contain hydroxy groups. They can, however, also contain amine, unsaturated alkyl, allyl or vinyl, or carboxyl groups as functional terminal groups.

Polyethylene oxide or polypropylene oxide mono- or diamine are commercially available (Chevron Deutschland GmbH, Hamburg). Examples of vinyl group-containing products are the esters of the glycols with corresponding acids, e.g. acrylic acid. Further suitable polymers are e.g. the polyesters that are commercially distributed, among other things, under the trade name Desmophen™ (Bayer AG, Leverkusen, Germany), e.g. Desmophen 170 HN, a reaction product of adipic acid, neopentylglycol and hexane-1,6-diol. Monomers with hydroxy (e.g. trimethylolpropane, hexane-1,6-diol), amino (e.g. hexane-1,6-diamine), (meth)acrylate (e.g. acrylic acid methyl ester), methacrylamide (e.g. acrylamide) or vinyl groups (e.g. styrene) can similarly be utilized.

As the liquid prepolymer, preferably at least one compound is used that comprises the hydroxy, amino, (meth) acrylate, methacrylamide and/or vinyl groups. Especially preferred is the use of a prepolymer with aliphatic polyether chains, such as e.g. trifunctional ethylene glycol, produced through ethoxylation of trimethylolpropane.

Electrolytes (II) in the sense of at least one embodiment of the present invention are such metal organic substances that, in molecular or ionic form, are soluble in the polymer (I) or its prepolymer, and that deposit on its surface or are dispersable in it. Examples of such electrolytes are e.g. free organic acids, or their salts with metal ions, alkali ions, alkaline earth ions or organic cations. Thus the electrolytes include salts such as sodium-, lithium-, potassium- or zinc-, -formiate, -acetate, -propionate, -isobutyrate, -aminoadipate, -benzoate, -dodecylsulfate, -ethylhexanoate, -lactate, -octanoate (-caprylate), -oxalate, -salicylate, -stearate, -tartrate, -trifluoroacetate, -trifluoromethanesulfonate (-triflate), -bis (trifluoromethylsulfonyl)imide, or -trifluoromethanesulfonate. The electrolytes can also be used as a mixture.

Additives (III) in the sense of at least one embodiment of the invention are such compounds that, mixed with (I) and (II) produce a homogeneous solid or liquid composition. Thus, e.g. for the use of a polyether as the polymer, capped low molecular polyethers, such as e.g. bismethylated trimethylolpropane or the esters of the phthalic acid are suitable as additives.

In that regard, the electrorheological composition can contain further additives, such as dispersants, stabilizers, e.g. against sedimentation, antioxidants, anti-wear agents, UV absorbers, etc.

If applicable, an additive (IV) (e.g. crosslinking agent) is added to the system before or after the emulsification of the basic substance, which additive, through reaction with the functional end groups of the prepolymers or the polymers (I), leads to the molecular weight increase in the emulsion droplets or also to the reduction of the number of the functional end groups. Depending on the type and the quantity of the utilized mixture components and of the additive, viscous or solid particles are formed, of which the spherical geometry is maintained during and after the reaction.

If the basic substance contains a glycol as component (I), then preferably di- or multi-functional isocyanates are used as crosslinking agents (IV). Isocyanates of various different structures can be obtained under the tradename Desmodur™ (Bayer AG). In the use of tri- or higher functional glycols, the use of toluoylene-diisocyanate as a crosslinking agent is especially suitable. However, the acetate, amine, benzamide, oxime and alkoxy crosslinking agents that are commonly known in silicone chemistry are also utilizable for the crosslinking. Radical crosslinking systems are suitable for the conversion of allyl or vinyl (acryl or methacryl) group modified polymer basic substances.

In a further preferred embodiment of the present invention, the disperse phase (that is to say the product of the basic substance and (IV)) is contained in a range of 1 to 80%, preferably 2 to 70%, especially preferably 5 to 65% (w/w) with respect to the total weight of the ERF.

As the dispersing agent (V) for the disperse phase it is possible to use surfactants that are soluble in the dispersion medium and that are derived, e.g., from amines, imidazoles, oxazoles, alcohols, glycol, or sorbitol. Also, polymers that are soluble in the dispersion medium can be used. For example, polymers are suitable, which contain 0.1 to 10% (w/w) N and/or OH, as well as 25 to 83% (w/w) $C_4$-$C_{24}$-alkyl groups and a molecular weight in the range from 500 to 1,000,000 Da. The N and OH-containing compounds in these polymers can be e.g. amine-, amide-, imide-, nitrile-, 5- to 6-membered N-containing heterocyclic rings, or an alcohol, and the $C_4$-$C_{24}$-alkyl groups esters of acrylic or methacrylic acid. Examples of the abovementioned N- and OH-containing compounds are N,N-dimethylaminoethyl-methacrylate, tert-butylacrylamide, maleinimide, acrylonitrile, N-vinylpyrrolidone, vinylpyridine and 2-hydroxyethyl-methacrylate. The abovementioned polymeric dispersing agents in general have the advantage, in comparison to the low-molecular surfactants, that the dispersions produced herewith are more stable with respect to the sedimentation or deposition behavior. For the dispersing in silicone oil, preferably polysiloxane-polyether copolymers are used, as they are for example available under the tradename Tegopren™ (Goldschmidt AG, Essen, Germany).

Besides the polyether-polysiloxanes, the reaction products of hydroxy-functional polysiloxanes with the various different silanes represent dispersing agents for the production of the ERF according to the invention. Especially preferred dispersing agents out of this class of substances are the reaction or conversion products of a hydroxy-functional polysiloxane with aminosilanes.

Besides liquid hydrocarbons, such as e.g. paraffins (e.g. n-nonane), olefins (e.g. 1-nonene, (cis, trans) 4-nonene) and aromatic hydrocarbons (e.g. xylene), also silicone oils such as polydimethylsiloxane and liquid methylphenylsiloxane with a dynamic viscosity of 3 to 300 mPa*s are used as the dispersion medium (VI) for the disperse phase. In a preferred embodiment of the invention, silicone oil is used as the dispersion medium. The dispersion medium can be used alone or in combination with other dispersion media. The solidification point of the dispersion medium is preferably set to below −30° C., the boiling point greater than 150° C.

The viscosity of the dispersion medium at room temperature (25° C.) lies between 3 and 300 mPa*s. In general the low-viscosity dispersion media with a viscosity from 3 to 20 mPa*s are to be preferred, because with these a lower base viscosity of the electrorheological compositions is achieved.

In order to avoid sedimentation, the dispersion medium should preferably have a density that approximately corresponds to the density of the disperse phase. Thereby it is possible, e.g. through the use of halogen- or fluorine-containing polysiloxanes, which can be used as a pure substance or as a mixture with silicone oils, to produce ERF according to the invention, which do not precipitate sediment over a longer time period despite a low base viscosity, and furthermore comprise a good re-dispersability.

Especially suitable for the production of re-dispersable electrorheological compositions, are fluorine-containing siloxanes of the general structure:

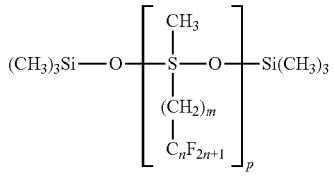

wherein n=1-10, m=2-18, p=1-5, and means.

In a manner of producing the ERF according to an embodiment of the invention, the basic substance is mixed with the reactive additive or the crosslinking agent (IV). After homogenizing the components, the mixture is dispersed into a liquid phase containing the dispersing agent. For this, in order to achieve a corresponding degree of dispersion, it is possible to use shear homogenizers, high pressure homogenizers, or ultrasound. The dispersing should, however, be carried out so that the desired particle size is not exceeded. As applicable, after the completed dispersing, one allows the product to react out over a longer time at a suitable temperature, which typically lies in a range from approximately 15 to 120° C.

In an alternative manner of production, the crosslinking agent is mixed into the dispersion only after the dispersing process.

Independent of the manner of production, one can, if applicable, separate the disperse phase from the original dispersing agent after the reaction and transfer it into a new dispersion medium.

In another manner or type of production, the basic substance, either with or without surfactant or additive (IV), is sprayed to form a fine powder, and the resulting powder is thereafter dispersed into the liquid phase.

DETAILED DESCRIPTION OF EXAMPLE EMBODIMENTS OF THE INVENTION

The following examples serve to explain the invention. The invention is, however, not limited to these examples.

The chemicals used for the syntheses, to the extent not otherwise mentioned, were obtained from Momentive Performance Materials Inc., Kurt Obermeier GmbH & Co. KG, Sigma Aldrich, Alfa Aesar, Merck KGaA, VWR and Carl Roth, and used directly or pre-treated with Molsieb (3 Å) as well as ion exchangers (e.g. DOWEX* G-26 (H) or DOWEX™ MAC-3).

The utilized glass and metal apparatuses were dried in a drying cabinet at 120° C. To exclude water, the reactions were provided with a drying tube (drying agent $CaCl_2$) or covered with argon or nitrogen as a protective gas.

The ERF that were produced as described in the following were examined and their properties were determined according to DIN 51480-1 in a modified rotational viscometer as has already been described by W. M. Winslow in J. Appl. Phys. 20 (1949), pages 1137-1140.

The measurement geometry is constructed as follows: cylinder diameter (of the rotating cylinder) 16.66 mm, gap width between the electrodes 0.7055 mm and length of the measuring gap 254.88 mm (standard according to ISO 3219). In dynamic measurements, the shear loading can be adjusted to a maximum of 1000 $s^{-1}$. The measuring range of the viscometer (Anton Paar, MCR 300 rheometer, Ostfildern, Germany) amounts to a maximum of 50 N. Both static as well as dynamic measurements are possible with this apparatus. The energization or excitation of the ERF can take place both with direct DC voltage as well as with alternating AC voltage.

Furthermore, the ERF properties were examined and measured in a test stand for determining hydraulic properties in the flowing mode. In that regard, an ER valve with an annular gap construction was utilized.

By producing a constant volume flow q and specifying various different voltage values (modulatable high voltage amplifier 0 to 6 kV; 130 W; rise time 0.5 to 5 kV at 1 nF max. 0.57 ms; decay time 5 to 0.5 kV at 1 nF 0.175 ms; model: RheCon®, company Fludicon GmbH, D-64293 Darmstadt), therewith the ER properties could be determined from the measured static pressure differences at the ER valve (pressure and temperature sensors at the inlet and outlet). The mathematical approximation used in that regard is based on the equivalent flat gap. The length L corresponds to the length of the electrode surface. For that purpose, the inlet and outlet of the annular gap were ignored or omitted as negligible. For calculating the width W, the average annular gap diameter $d_m=(d_1+d_2)/2$ was utilized. Then the gap width W is given by $W=d_m\pi$. The gap height H corresponds to the spacing distance of the electrode to the outer pipe and is calculated according to: $H=(d_2-d_1)/2$ (dimensions: length L=100 mm; inner electrode diameter $d_1$=39.5 mm; outer electrode diameter $d_2$=40.5 mm; thereby there arises a gap height H=0.5 mm; and an average annular gap diameter $d_m$=40 mm).

Using a Bingham-type material law, from the measured pressure differences, the field-strength-dependent yield point or liquid flow limit $\tau_0(E)$ was determined.

$$\sigma_{12}=\tau_0(E)\sin(\dot{\gamma})+\eta\dot{\gamma} \text{ for } \dot{\gamma}\neq 0$$

Therein, $\sigma_{12}$ represents the shear stress (or thrust stress), E represents the electric field strength, $\eta$ represents the dynamic base viscosity, and $\dot{\gamma}$ represents the shear rate (10000 $s^{-1}$). With the explained parameters, then the dynamic base viscosity $\eta$ can be calculated according to the following equation.

$$\eta = \frac{WH^3}{12L}\frac{\Delta p_1}{q}$$

For the determination of the yield point, the corresponding field strength is calculated from the prescribed voltage values $U_i$ according to:

$$E_i = \frac{U_i}{H}$$

The measured pressure differences $\Delta p_i$ are converted by calculation into a pressure gradient $$P_i = \frac{\Delta p_i}{L}$$

Furthermore, the abovementioned system parameters are calculated into an intermediate value (geometry factor)

$$\Phi_i = \arccos\left(\frac{12\eta q}{WP_iH^3} - 1\right)$$

from which the values of the field-strength-dependent yield point can be calculated by $$\tau_{0,i} = P_iH\cos\left(\frac{\Phi_i}{3} + \frac{4\pi}{3}\right)$$

The ER properties can be judged or evaluated via a graphical plot or a tabular representation of the measured and calculated parameters.

A simple static test was called upon for the evaluation of the corrosion-inhibiting properties. Two electrode plates (electrode surface area 2500 $mm^2$, material: structural steel S235JR+AR; spacing distance 0.5 mm) arranged parallel to one another had 6 kV (modulatable high voltage amplifier 0 to 6 kV; 130 W; rise time 0.5 to 5 kV at 1 nF max. 0.57 ms; decay time 5 to 0.5 kV at 1 nF 0.175 ms; model: RheCon®, company Fludicon GmbH, Darmstadt) applied to them over 24 h (80° C.) in a tempered solution of the respective ER fluid. Thereafter, the surface corrosion was optically or visually compared and divided into three categories ("+" no corrosion visible; "○" slight changes of the surface; "–" strong corrosion of the surface ("rust formation")).

Comparative Example 1

1902 g of trifunctional polyethylene glycol were heated to 60° C., then 6.6 g of lithium chloride and 16.7 g of diazocyclo[2.2.2]octane were added and stirred for 2 h. After cooling to RT, 2300 g of silicone oil (polymethylsiloxane: viscosity κ $mm^2/s$; density 0.9 $g/cm^3$ at 25° C.) and 43.5 g of emulsifier OF 7745 (Momentive Performance Materials Holding GmbH, Leverkusen) were added and homogenized with a jet disperser (1 h, 6 bar). The resulting emulsion was then mixed with 536 g of toluoldiisocyanate. The dispersion was cured overnight at 30 to 60° C.

Example 1

1900 g of trifunctional polyethylene glycol were heated to 60° C., then 1.7 g of lithium acetate and 5.5 g of diazocyclo [2.2.2]octane were added and stirred for 2 h. After cooling to RT, 2300 g of silicone oil (polymethylsiloxane: viscosity 5 $mm^2/s$; density 0.9 $g/cm^3$ (at 25° C.)) and 43.5 g of emulsifier OF 7745 (Momentive Performance Materials Holding GmbH, Leverkusen) were added and homogenized with a jet disperser (1 h, 9 bar). The resulting emulsion was then mixed with 524 g of toluoldiisocyanate. The dispersion was cured overnight at 30 to 60° C.

Example 2

Production according to the Example 1, except the polyethylene glycol was doped with 7.5 g of lithium stearate. For that, a precursor solution of 300 g of polyethylene glycol was stirred overnight at 60° C. and then homogenized at RT with the Ultra-Turrax™ (IKA-Werke GmbH, Staufen, Germany) and provided to the synthesis.

Example 3

Production according to Comparative Example 1, except the polyethylene glycol was doped with 3.3 g of lithium benzoate.

Example 4

Production according to Comparative Example 1, except the polyethylene glycol was doped with 4.0 g of lithium trifluoromethane sulfonate.

Example 5

Production according to Comparative Example 1, except the polyethylene glycol was doped with 2.7 g of lithium oxalate.

Example 6

Production according to Comparative Example 1, except the polyethylene glycol was doped with 5.5 g of magnesium citrate.

Example 7

Production according to Comparative Example 1, except the polyethylene glycol was doped with 1.1 g of silver citrate.

Example 8

Production according to Comparative Example 1, except the polyethylene glycol was doped with 11.8 g of zinc gluconate.

Example 9

Production according to Comparative Example 1, except the polyethylene glycol was doped with 7.4 g of sodium lauryl sulfate. For that, a precursor solution of 300 g of polyethylene glycol was stirred overnight at 60° C., homogenized with the Ultra-Turrax™ (IKA-Werke GmbH, Staufen, Germany), and provided to the synthesis.

Example 10

39 g of trifunctional polyethylene glycol are heated to 60° C., then 0.04 g of lithium acetate and 0.1 g of diazacyclo [2.2.2]octane are added and stirred for 2 h. After cooling to RT, 50 g of silicone oil (polymethylsiloxane: viscosity 5 $mm^2/s$; density 0.9 $g/cm^3$ (at 25° C.)) and 1 g of emulsifier OF 7745 (Momentive Performance Materials Holding GmbH, Leverkusen) are added and homogenized with the Ultra-Turrax™ (IKA-Werke GmbH, Staufen, Germany). The resulting emulsion is thereafter slowly mixed with 11 g of toluoldiisocyanate. The dispersion is cured overnight at 30 to 60° C.

Example 11

Production according to Example 10, however alternatively 0.04 g of lithium benzoate and 0.03 g of zinc acetate are used.

Example 12

Production according to Example 11, except alternatively 0.07 g of lithium stearate are used.

TABLE 1

Property Overview of ER Compositions

| Example No.: | Dyn. Base Viscosity [mPa * s] | Yield Point [Pa] | Current Density $mA/cm^2$ | Corrosion Behavior* |
|---|---|---|---|---|
| comparative example | 40 | 5500 | 40 | – |
| 1 | 30 | 5000 | 4 | + |
| 2 | 35 | 4500 | 2 | + |
| 3 | 22 | 2000 | 4 | + |
| 4 | 30 | 2000 | 28 | ○ |
| 5 | 28 | 2000 | 3 | + |
| 6 | 28 | 3500 | 5 | + |
| 7 | 35 | 4200 | 5 | + |
| 8 | 22 | 3000 | 4 | + |
| 9 | 22 | 2000 | 18 | + |

*+ no corrosion visible; ○ slight changes of the surface; – strong corrosion of the surface; measurement in the annular gap: at 40° C.; shear rate 10000 $s^{-1}$; yield point at 2.5 kV applied voltage.

The ERF produced according to the Examples 1 to 9 comprised excellent corrosion-inhibiting properties.

The invention claimed is:

1. An electrorheological composition, comprising:

a polymer or polymer mixture;

at least one electrolyte dissolved or dispersed in the polymer or polymer mixture;

at least one dispersing agent; and at least one non-aqueous dispersion medium;

wherein the at least one electrolyte is at least one organic ionic compound selected from a group consisting of lithium acetate, lithium stearate, lithium benzoate, lithium trifluoromethane sulfonate, lithium oxalate, magnesium citrate, silver citrate, zinc gluconate and sodium lauryl sulfate, and wherein the composition contains from $1\times10^{-6}$ to $5\times10^{-3}$ weight percent of inorganic anions.

2. The electrorheological composition according to claim 1, wherein the polymer or polymer mixture consists of linear or branched polyethers or oligomonomers thereof, or a reaction or conversion product of said polyethers or said oligomonomers thereof with mono- or oligo-functional compounds.

3. The electrorheological composition according to claim 1, wherein the polymer or polymer mixture consists of linear or branched, functionalized polyethers or oligomonomers thereof, or a reaction or conversion product of said polyethers or said oligomonomers thereof with mono- or oligo-functional compounds.

4. The electrorheological composition according to claim 1, wherein the polymer or polymer mixture, or mono- and/or oligo-meric initial substances thereof, are present in a liquid form during a dispersing process for producing the composition.

5. The electrorheological composition according to claim 1, wherein the polymer or polymer mixture, or mono- and/or oligo-meric initial substances thereof, are present in a liquid form during a dispersing process for producing the composition, and are converted into a higher viscosity or solid form through an addition of reactive additives before, during or after the dispersing process.

6. The electrorheological composition according to claim 1, wherein the at least one non-aqueous dispersion medium is at least one compound selected from a group consisting of silicone oils, fluorine-containing siloxanes and hydrocarbons.

7. The electrorheological composition according to claim 1, wherein the at least one dispersing agent is at least one compound selected from a group consisting of polysiloxane-polyether-copolymerisates, amino group-containing alkoxy-polysiloxanes and amino group-containing acetoxypolysiloxanes.

8. The electrorheological composition according to claim 1, having a corrosion-inhibiting property.

9. The electrorheological composition according to claim 1, further comprising at least one additive that is miscible with a solution of the at least one electrolyte dissolved in the polymer or polymer mixture.

10. The electrorheological composition according to claim 1, further comprising at least one viscosity-increasing additive that reacts with the polymer or polymer mixture.

11. The electrorheological composition according to claim 10, containing from $1\times10^{-6}$ to $1\times10^{-3}$ weight percent of the inorganic anions.

12. The electrorheological composition according to claim 1, containing from $1\times10^{-6}$ to $1\times10^{-3}$ weight percent of the inorganic anions.

13. The electrorheological composition according to claim 1, consisting essentially of the polymer or polymer mixture, the at least one electrolyte, the at least one dispersing agent, the at least one non-aqueous dispersion medium, and containing from $1\times10^{-6}$ to $5\times10^{-3}$ weight percent of the inorganic anions.

14. The electrorheological composition according to claim 1, consisting essentially of the polymer or polymer mixture, the at least one electrolyte, the at least one dispersing agent, the at least one non-aqueous dispersion medium, optionally at least one additive that is miscible with a solution of the at least one electrolyte dissolved in the polymer or polymer mixture, optionally at least one viscosity-increasing additive that reacts with the polymer or polymer mixture, and containing from $1\times10^{-6}$ to $5\times10^{-3}$ weight percent of the inorganic anions.

15. A combination comprising the electrorheological composition according to claim 1 incorporated in a component selected from a group consisting of adaptive shock, vibration and/or impact dampers, electrically controllable clutches and/or brakes, sport and/or medical exercise devices, haptic and/or tactile systems, operating elements, mechanical fixing devices, hydraulic valves, devices for simulation of viscous, elastic and/or visco-elastic properties, devices for simulation of a consistency distribution of an object, devices for training and/or development purposes, protective clothing, and medical devices.

16. A method of producing the electrorheological composition according to claim 1, comprising preparing and dispersing the polymer or polymer mixture, the at least one electrolyte, the at least one dispersing agent, and the at least one non-aqueous dispersion medium, and removing therefrom excessive inorganic anions to result in a content of the inorganic anions therein from $1\times10^{-6}$ to $5\times10^{-3}$ weight percent.

17. The electrorheological composition according to claim 1, containing more than 25 weight percent and up to 40 weight percent of the at least one electrolyte with respect to a total weight of particles contained in the electrorheological composition.

18. The electrorheological composition according to claim 17, wherein the total weight of the particles amounts to at least 63 weight percent and up to 70 weight percent of the electrorheological composition.

19. The electrorheological composition according to claim 18, containing more than 25 weight percent of the at least one electrolyte with respect to a total weight of the electrorheological composition.

* * * * *